US010648761B1

(12) United States Patent
Elezar

(10) Patent No.: US 10,648,761 B1
(45) Date of Patent: May 12, 2020

(54) INTERCHANGEABLE BOW GRIP SYSTEM

(71) Applicant: Saar Elezar, Brooklyn, NY (US)

(72) Inventor: Saar Elezar, Brooklyn, NY (US)

( * ) Notice: Subject to any disclaimer, the term of this patent is extended or adjusted under 35 U.S.C. 154(b) by 0 days.

(21) Appl. No.: 16/654,765

(22) Filed: Oct. 16, 2019

Related U.S. Application Data

(60) Provisional application No. 62/803,248, filed on Feb. 8, 2019.

(51) Int. Cl.
*F41B 5/00* (2006.01)
*F41B 5/14* (2006.01)

(52) U.S. Cl.
CPC ..... *F41B 5/1403* (2013.01); *F41B 5/00* (2013.01); *F41B 5/14* (2013.01)

(58) Field of Classification Search
CPC ..... F41B 5/00; F41B 5/14
See application file for complete search history.

(56) References Cited

U.S. PATENT DOCUMENTS 4,124,014 A * 11/1978 Darlington ..... F41B 5/10 124/88
4,966,124 A 10/1990 Burling
5,241,945 A 9/1993 Shepley, Jr.
5,243,958 A * 9/1993 Shepley, Jr. ..... F41B 5/0031 124/23.1
5,469,834 A 11/1995 Higgins et al.
5,551,413 A 9/1996 Walk
5,615,663 A 4/1997 Simonds
5,701,880 A * 12/1997 Simonds ..... F41B 5/14 124/23.1
5,842,460 A * 12/1998 Barber ..... F41B 5/14 124/88
6,662,798 B1 * 12/2003 Johnson ..... F41B 5/0005 124/88
8,033,274 B2 * 10/2011 Pedemonte ..... F41B 7/04 124/20.3
9,377,268 B2 6/2016 Gold et al.
2016/0076849 A1 3/2016 Gold et al.

* cited by examiner

*Primary Examiner* — John A Ricci
(74) *Attorney, Agent, or Firm* — Johan Eide; Christopher Pilling; My Patent Guys

(57) ABSTRACT

The present invention relates to an interchangeable bow grip system that allows an archer or a user to change an interchangeable angled member when desired. The angled member rests between the hand of the archer and a base plate adjoined to the riser of a bow. The angle of the angled member can match the desired grip for various environmental conditions, hand sizes, and target locations. The interchangeable bow grip system including a grip mounting area, a base plate, an angled member, and a grip pad.

18 Claims, 10 Drawing Sheets

INTERCHANGEABLE BOW GRIP SYSTEM

RELATED APPLICATION

This application claims priority to provisional patent application U.S. Ser. No. 62/803,248 filed on Feb. 8, 2019.

BACKGROUND

1. Field of the Invention

The present invention relates to an interchangeable bow grip system for improving archery technique.

2. Description of Related Art

Archery has been a common art for centuries and is constantly being improved upon as technology in the art is advancing. Among one of the most important aspects of archery in the method and technique the archer uses when holding a traditional bow or a compound bow. Grip strength, grip torque, and the surface area of hand contact are among many factors relating to the grip of a bow that influence accuracy and proper technique in the art of archery. Traditionally most bows have a grip centered between an upper limb and a lower limb, or a grip with a centroid located below the midpoint between the upper limb and the lower limb. A riser of a traditional bow is either made to have a grip attached to the riser or a grip is traditionally designed into the ergonomic shape of the riser of a bow.

Problems arise when different archers having different arm lengths, hand sizes, arm strength, and skill sets attempt to utilize a standard bow grip. Secondly, different archery techniques and target locations often call for different bow grip types or styles. For example, archers often will utilize different sizes and styles of grips when shooting at targets positioned at an inclined angle in comparison to a downward angle. Furthermore, archers spend a vast amount of time and effort to properly adjust or create custom bow grips, often to be permanently attached to the riser of a bow. Consistency is highly sought after in the art of archery and once a grip is mounted by an archer, the archer tends to change their hand position rather than spending the time to correct an incorrectly sized grip. This directly leads to incorrect and improper archery form. An improved system is needed for allowing archers to customize their bow grip to improve proper technique in varying scenarios, such as environmental conditions, hand size, and target location. An improved system is also needed to reduce installation time and re-installation time when changes to a bow grip are desired by the archer.

SUMMARY

In order to solve the problems presented above, an interchangeable bow grip system is provided that allows the archer or the user to change an interchangeable angled member when desired. The angled member rests between the hand of the archer and a base plate adjoined to the riser of a bow. The angle of the angled member can match the desired grip for various environmental conditions, hand sizes, and target locations. Optimizing the correct angled member for each user allows the user increased control of the bow and accuracy of the arrows it fires by aiding in control of surface area contact, grip pressure, and torque imposed by the hand of the user on the riser of the bow.

The present invention relates to an interchangeable bow grip system providing an improved grip mounting area arranged along a midsection of a riser of a bow, a base plate having a first attachment opening, and a first attachment member arranged within the first attachment opening of the base plate. The first attachment member is configured to hold the base plate to the riser of a bow. Next an interchangeable angled member is adjoined to the base plate having an interchangeable angled member front surface immediately adjacent and joined to the base plate front surface, and an interchangeable angled member rear surface positioned at a grip angle relative to the angled member front surface. The angled member rear surface contacts the hand of the user and aides in securing a hand of an archer securely and in proper position relative the riser of the bow. The angled member also includes a second attachment opening arranged on the angled member front surface and a second attachment member arranged within the second attachment opening of the angled member. The second attachment member holds the angled member in place along the base plate rear surface.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

FIG. 10B shows an exemplary perspective view of one embodiment of the base plate of interchangeable bow grip system.

DETAILED DESCRIPTION OF CERTAIN EMBODIMENTS

Figure 1:
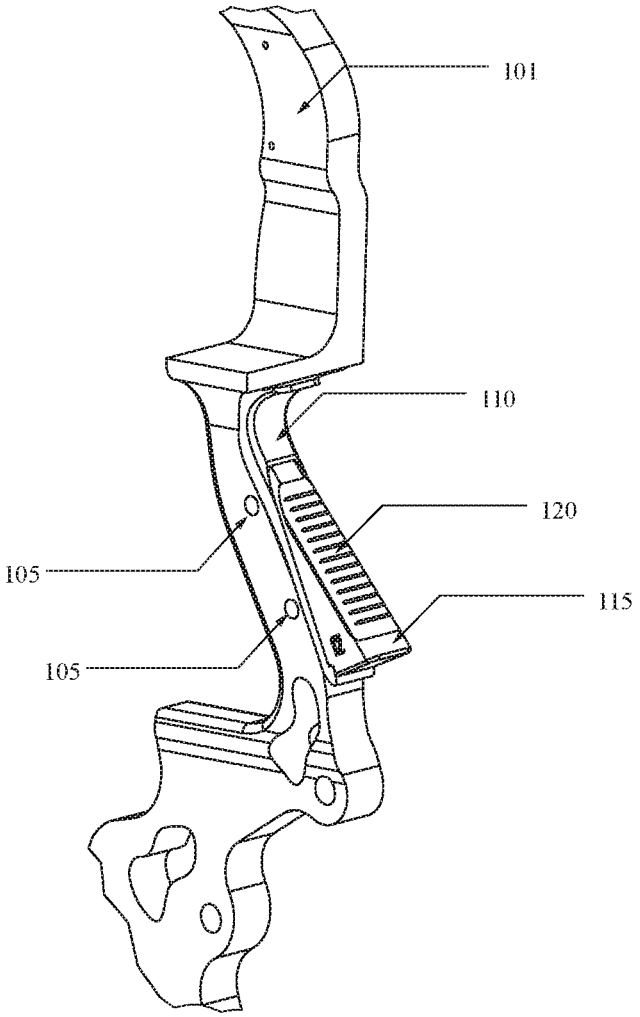
FIG. 1 shows an exemplary perspective view of one embodiment of the interchangeable bow grip system mounted to an exemplary bow riser.
Figure 2:
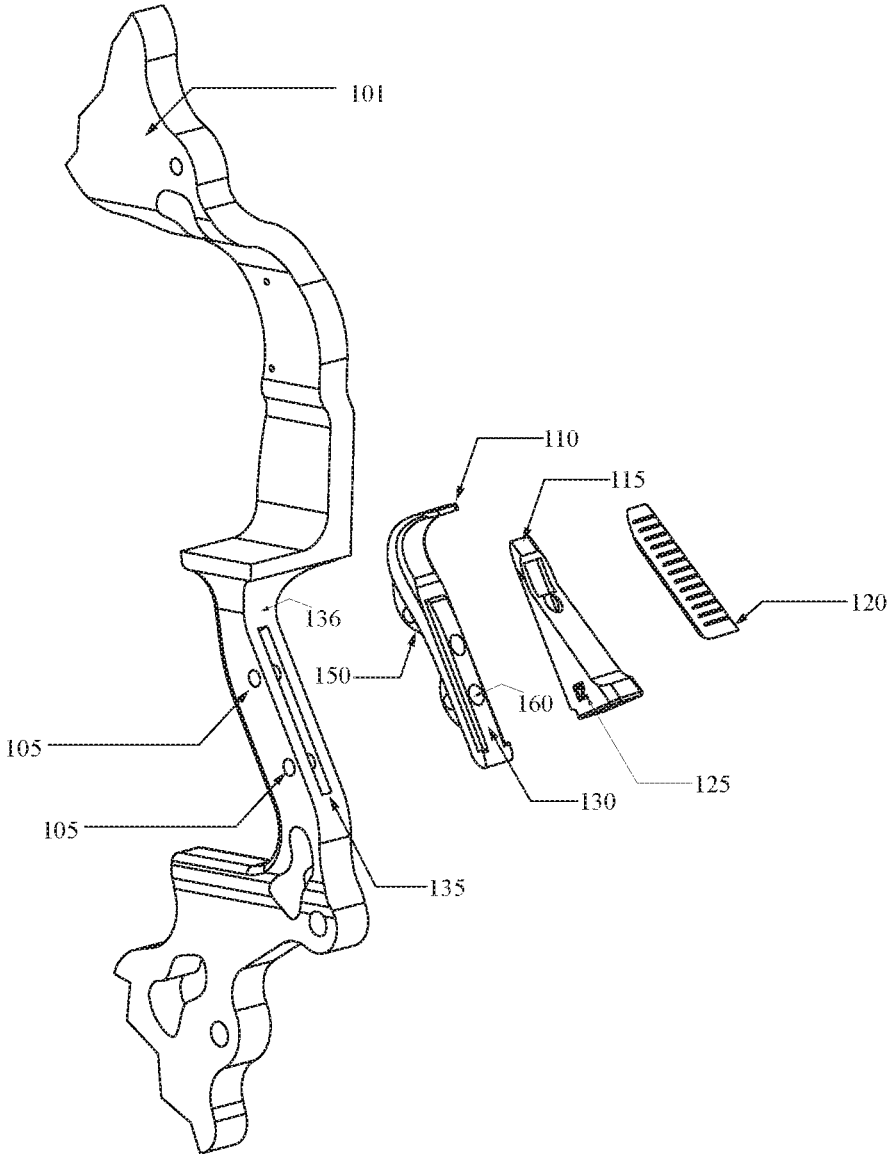
FIG. 2 shows an exemplary perspective view of one embodiment of the interchangeable bow grip system shown in an exploded view mounted to an exemplary bow riser.
Figure 3:
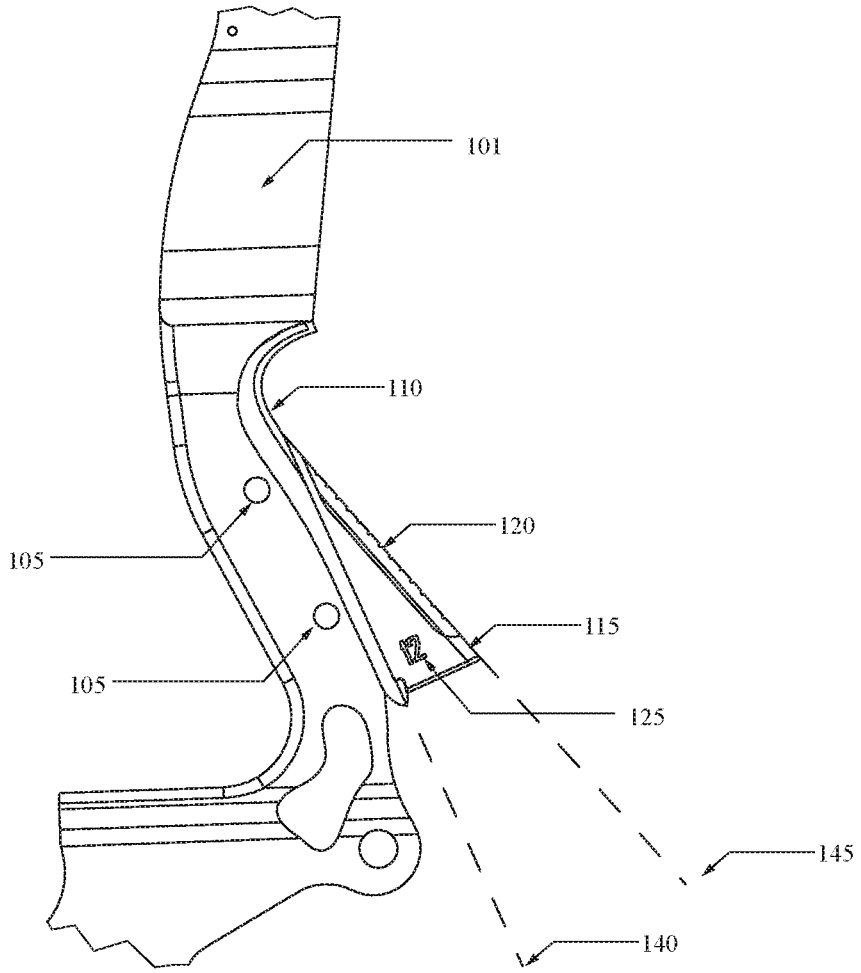
FIG. 3 shows an exemplary left view of one embodiment of the interchangeable bow grip system.
Figure 4:
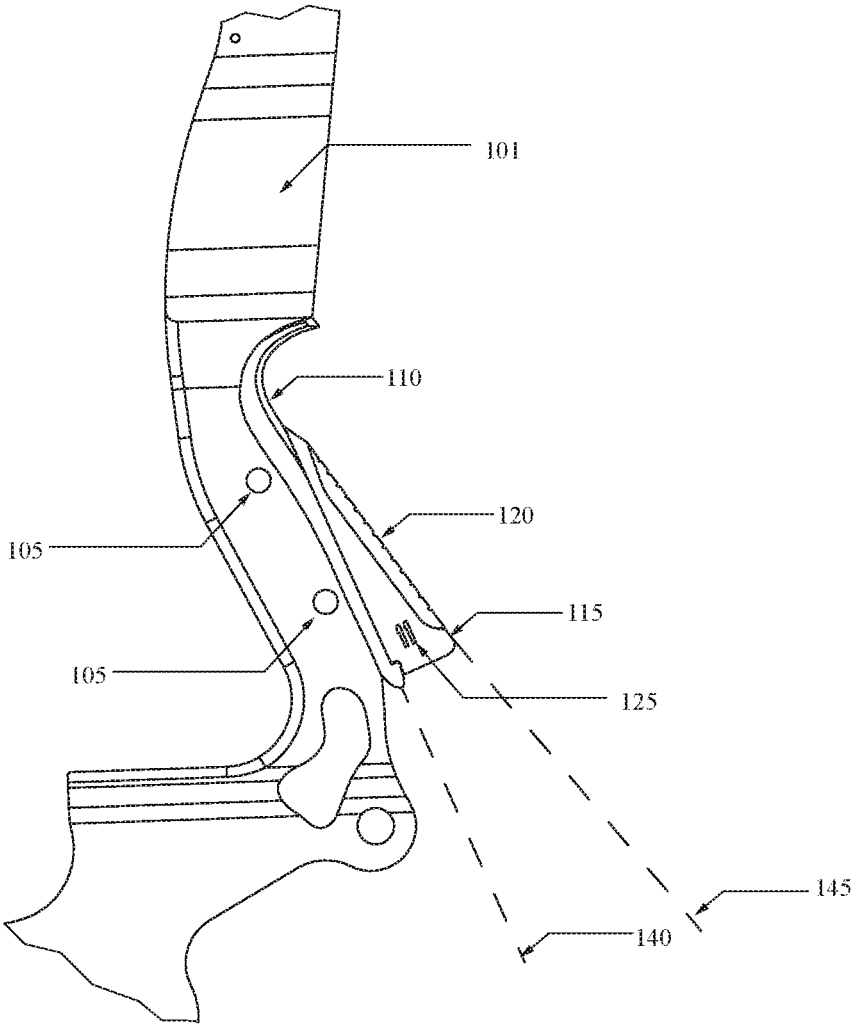
FIG. 4 shows an exemplary left view of one embodiment of the interchangeable bow grip system.
Figure 5:
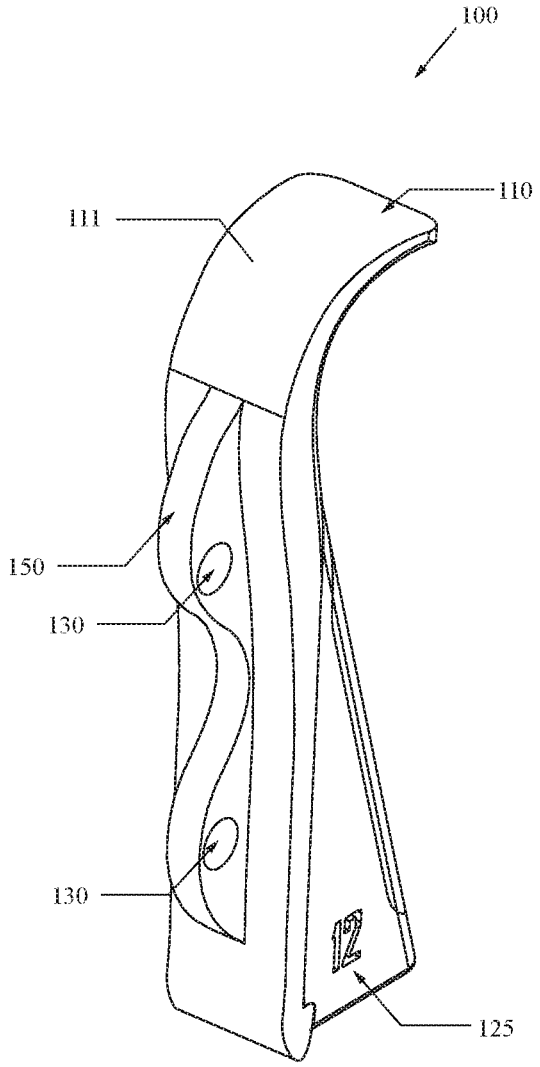
FIG. 5 shows an exemplary perspective view of one embodiment of the interchangeable bow grip system.
Figure 6:
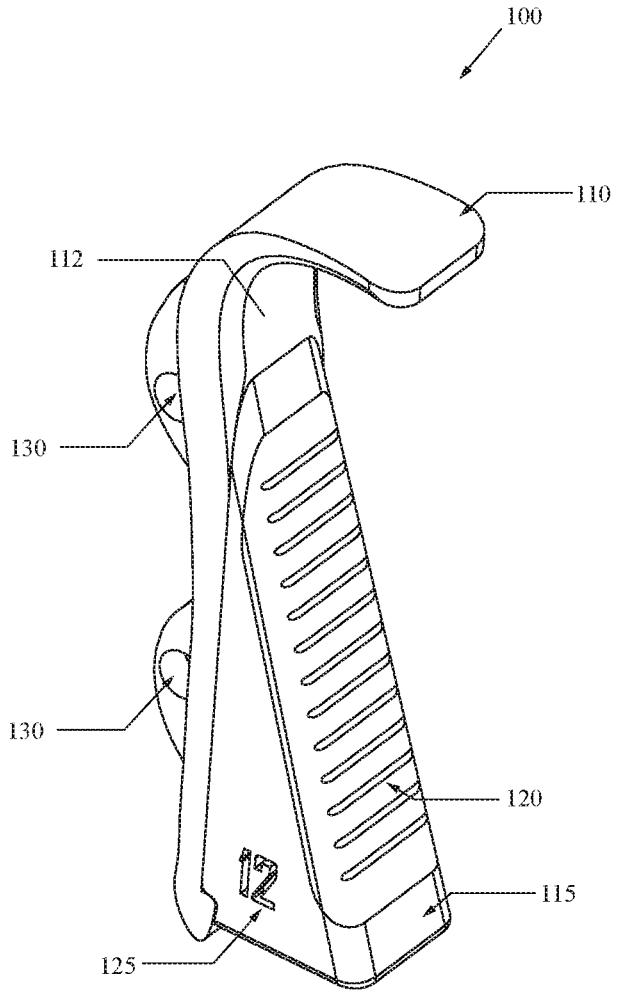
FIG. 6 shows an exemplary perspective view of one embodiment of the interchangeable bow grip system.
Figure 7:
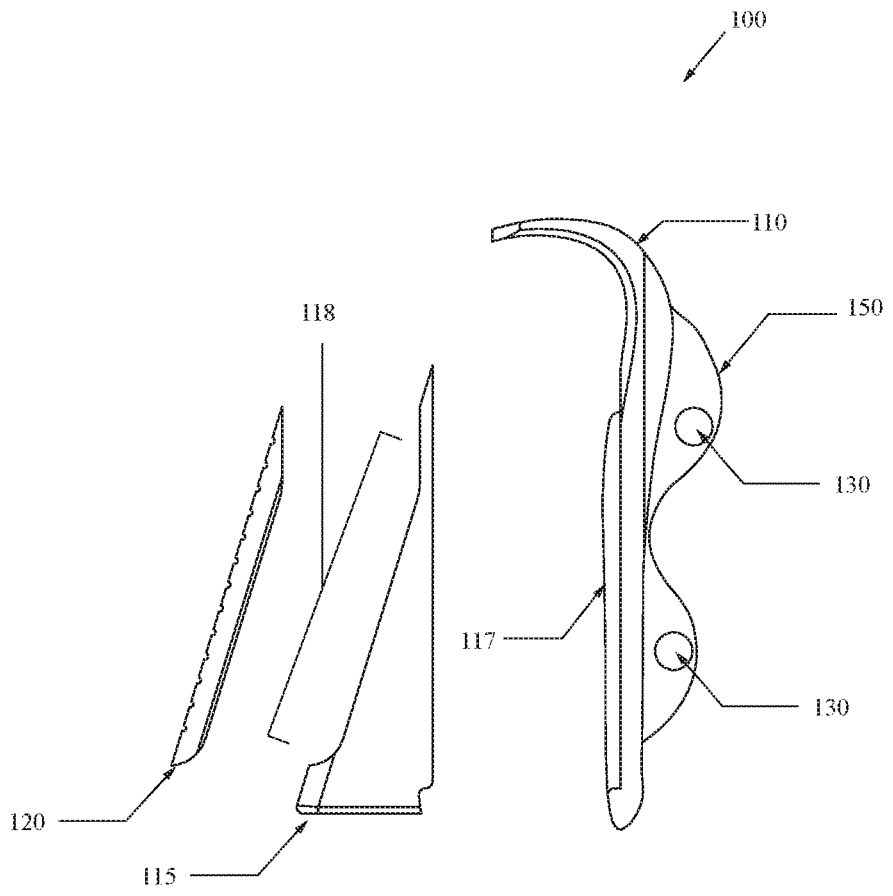
FIG. 7 shows an exemplary right view of one embodiment of the interchangeable bow grip system.
Figure 8:
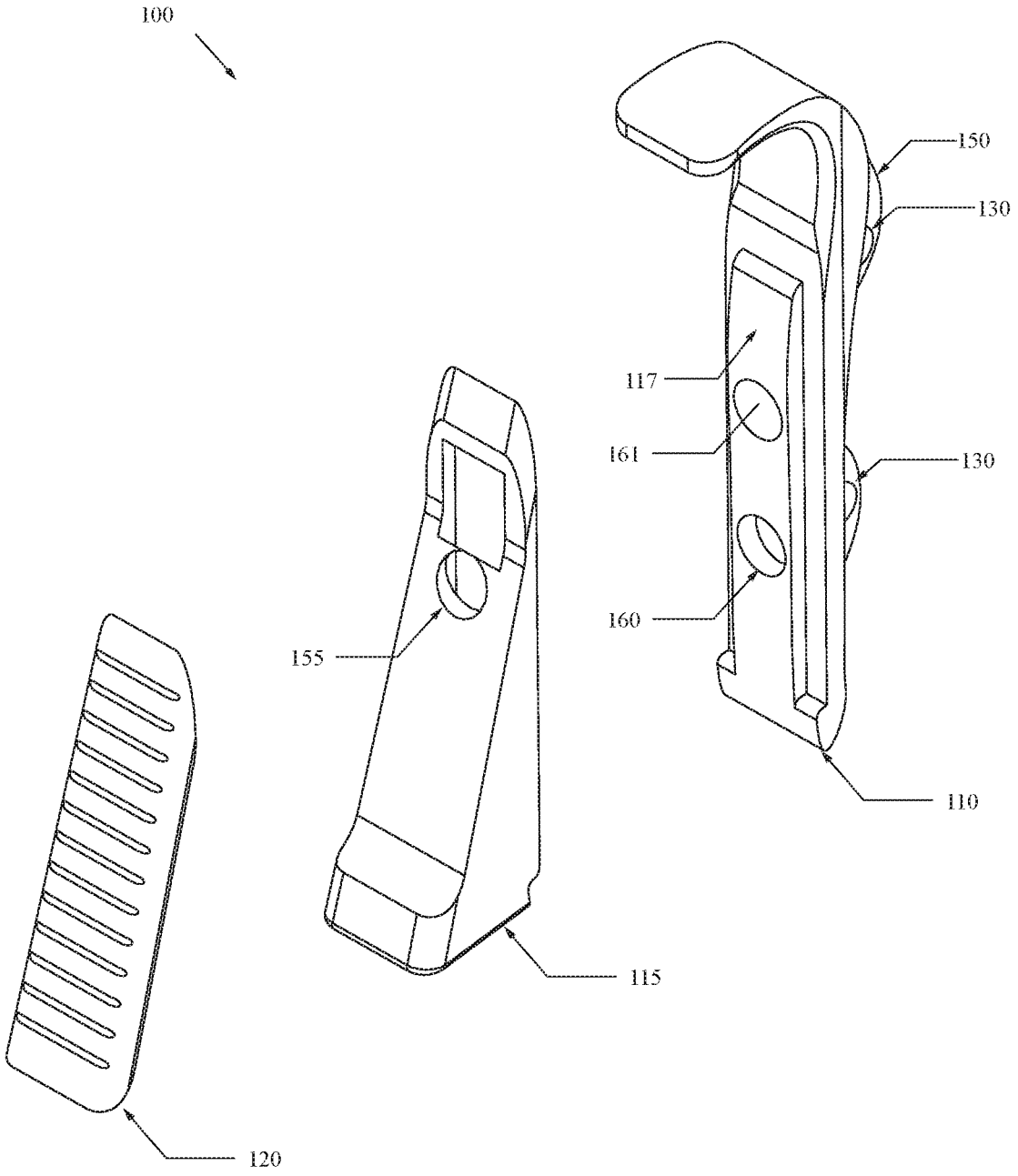
FIG. 8 shows an exemplary perspective view of one embodiment of the interchangeable bow grip system shown in an exploded view.

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

FIGS. 1-11 illustrates the interchangeable bow grip system 100 adjoined to an exemplary embodiment of a riser 101 of a bow. Upon the riser 101 of the bow a grip mounting area 136 is arranged along a midsection of the riser 101 of a bow, wherein the riser 101 serves as a connecting member between a top limb of the bow (not shown) and a bottom limb of the bow (not shown). In some embodiments, the grip mounting area 136 may be arranged at any location along the riser 101 between the top limb and the bottom limb. The interchangeable bow grip system 100 further includes a base plate 110 having a base plate rear surface 112 and a base plate front surface 111 immediately adjacent to the grip mounting area 136. The base plate front surface being configured to substantially match the shape and size of different risers of commercially available bow manufacturers. In some embodiments, the base plate 110 is made of at least one member of a material set consisting of: a wood material, a plastic material, a metal material, a rubber material, a polymer material, a fiberglass material, and a composite material.

In some embodiments, a first attachment opening 130 is arranged on the base plate front surface 111 and/or a first attachment member 105 is arranged on the base plate front surface 111. In other embodiments, the first attachment member 105 is arranged within the first attachment opening 130 of the base plate 110. The first attachment member 105 holds the base plate 110 to the grip mounting area 136 of the riser 101. Next, an interchangeable angled member 115 is adjoined to the base plate 110. The interchangeable angled member 115 includes a front surface 140 immediately adjacent and joined to the base plate rear surface 112 when assembled. The interchangeable angled member 115 includes a rear surface 118. In some embodiments, the interchangeable angled member 115 is made of at least one member of a material set consisting of: a wood material, a plastic material, a metal material, a rubber material, a polymer material, a fiberglass material, and a composite material. The interchangeable angled member 115 can be interchangeable and replaceable based on the grip angle 145 desired by the user of the bow. In some embodiments, the interchangeable angled member 115 further comprises at least one at least one member of an identification set consisting of: an alphanumeric identification, a human user's name, a symbolic shape, a company brand, a numeric identification number, a QR code, and a barcode. In some embodiments, at least one member of the identification set is directly related to the grip angle 145 of the interchangeable angled member 115 rear surface relative to the interchangeable angled member 115 front surface 140.

The rear surface 118 of the interchangeable angled member 115 is positioned at a grip angle 145 relative to the interchangeable angled member 115 front surface 140. The rear surface 118 of the interchangeable angled member 115 aides in securing a hand of an archer. In some embodiments, the grip angle 145 comprises an angle between 0 and 75 degrees. The first attachment member 105 comprises at least one member of an attachment set consisting of: a magnet, a clip, a heat-shrink material flange, a slide-fit, a clamp, a spring, a fastener, an elastic member, and an adhesive.

Figure 9:
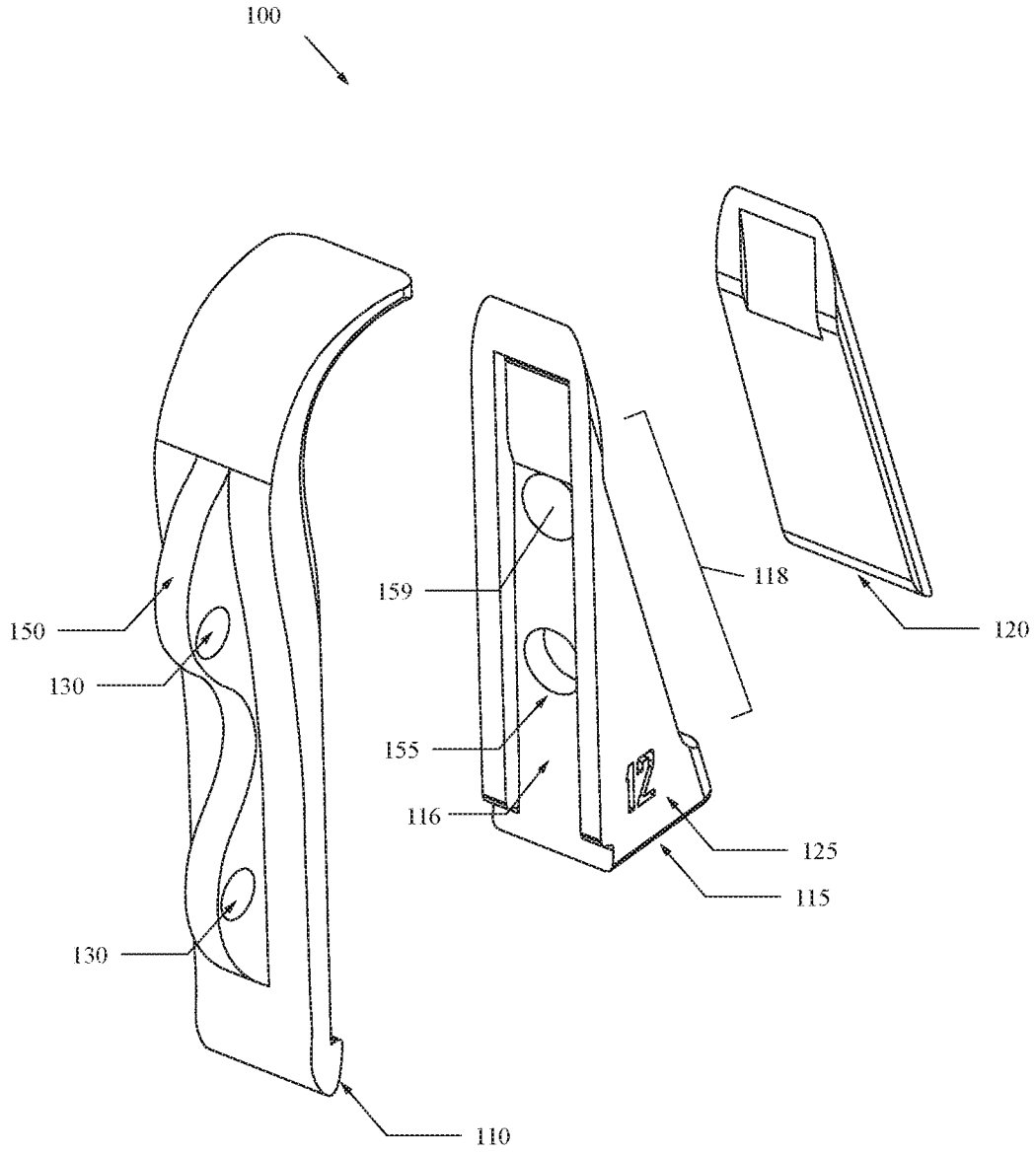
FIG. 9 shows an exemplary perspective view of one embodiment of the interchangeable bow grip system shown in an exploded view.
Figure 10A:
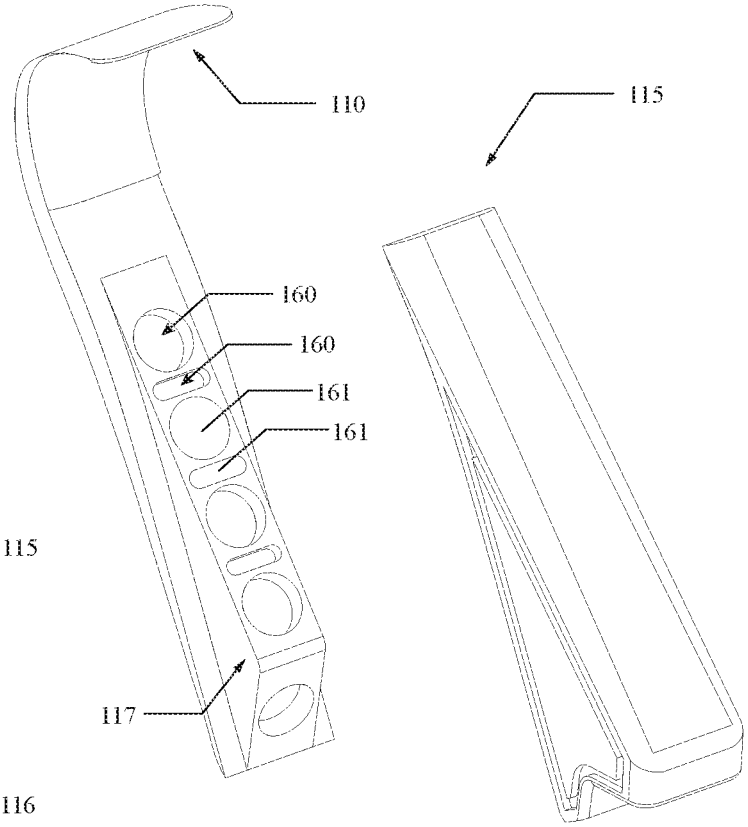
FIG. 10A shows an exemplary perspective exploded view of one embodiment of the interchangeable bow grip system.
Figure 10B:
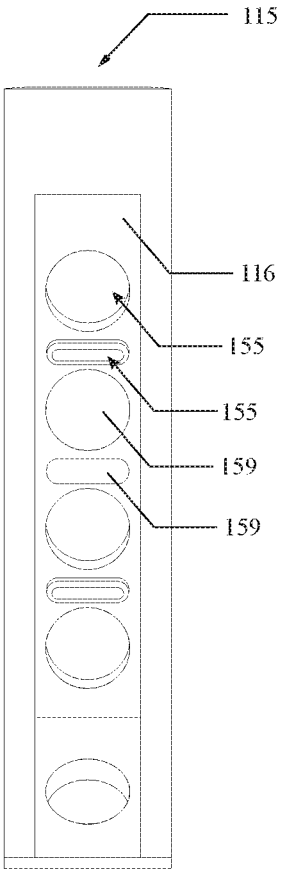
FIG. 10B shows an exemplary front view of one embodiment of the interchangeable angled member of the interchangeable bow grip system.
Figure 11:
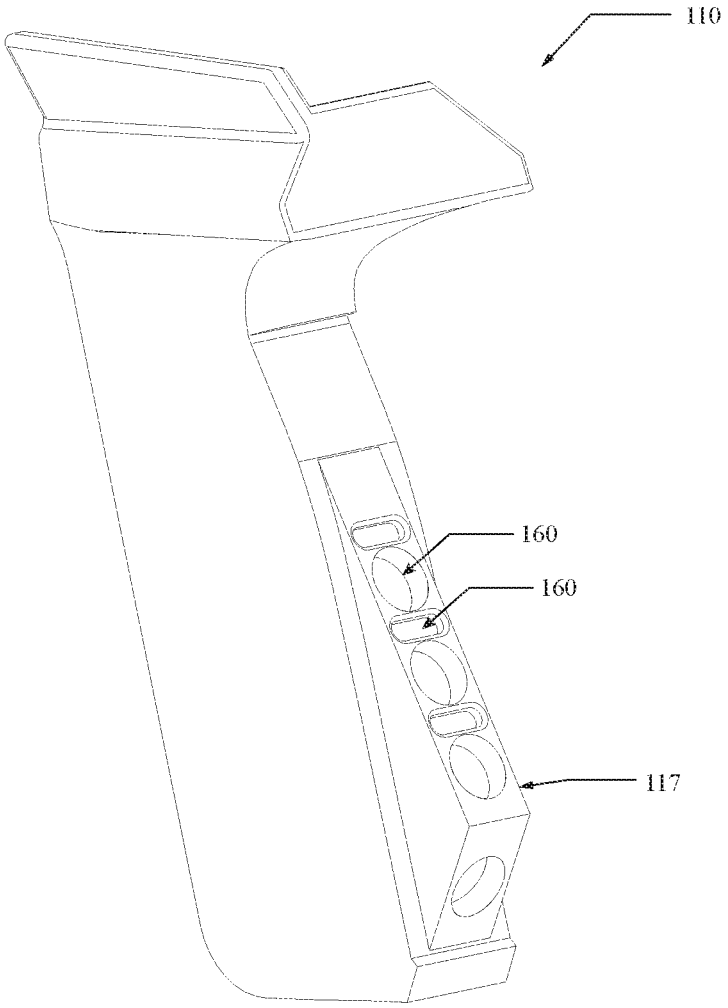

In some embodiments, a second attachment opening 155 (as seen in FIG. 9) arranged on the interchangeable angled member 115 front surface 140. In some embodiments, a second attachment member 159 is arranged within the second attachment opening 155 of the interchangeable angled member 115, wherein the second attachment member 159 is configured to hold the interchangeable angled member 115 front surface 140 in place along the base plate rear surface 112. In some embodiments, the second attachment member 159 comprises at least one member of an attachment set consisting of: a magnet, a clip, a heat-shrink material flange, a slide-fit, a clamp, a spring, a fastener, an elastic member, and an adhesive.

In some embodiments, a third attachment opening 160 is arranged on the base plate rear surface 112. In some embodiments, a third attachment member 161 is arranged within the third attachment opening 160 of the base plate 110. The third attachment member 161 is configured to aide in connecting the interchangeable angled member 115 front surface 140 in place along the base plate rear surface 112. In some embodiments, the third attachment member 161 is designed to be adjoined to the second attachment member 159 which is joined to the interchangeable angled member 115 front surface 140. For example, in some embodiments, the third attachment member 161 comprises of a north side of a magnet and the second attachment member 159 comprises of a south side of a magnet. In some embodiments, the third attachment member 161 comprises at least one member of an attachment set consisting of: a magnet, a clip, a tab, a slot, a rail, a joint, a heat-shrink material flange, a slide-fit, a clamp, a spring, an elastic member, a snap-fit, a fastener, an elastic member, an adhesive or any combination thereof.

In some embodiments, the interchangeable bow grip system 100 includes a first locking tab 150 joined to the base plate front surface 111, wherein the first locking tab 150 extends above the base plate rear surface 112. In assembly, the first locking tab 150 is inserted into a first locking slot 135 arranged along the grip mounting area 136 extending into the riser 101 of a bow. In an assembled position, the first locking tab 150 rests within the first locking slot 135, therein the first locking tab 150 and the first locking slot 135 aide in the rigidity of the interchangeable bow grip system 100 by securing the base plate 110 to the riser 101 of the bow. In some embodiments, the first attachment opening 130 is located on the first locking tab 150.

In some embodiments, the base plate 110 of the interchangeable bow grip system 100 includes a second locking tab 117 joined to the base plate rear surface 112, extending above the base plate rear surface 112. In some embodiments, the interchangeable angled member 115 of the interchangeable bow grip system 100 includes a second locking slot 116 arranged within the interchangeable angled member 115 front surface 140 and protruding into the front surface 140 the interchangeable angled member 115. The first locking tab 150 rests within the first locking slot 135 when assembled. Therein, the second locking tab 117 and the second locking slot 116 aids in securing the interchangeable angled member 115 to the base plate 110, thereby improving the rigidity of the interchangeable bow grip system 100. In some embodiments, the second attachment opening 155 is located within the second locking slot 116 on the front surface 140 of the interchangeable angled member 115. In some embodiments, the third attachment opening 160 is located on the second locking tab 117 located on the base plate rear surface 112.

In some embodiments, the rear surface 118 of the interchangeable angled member 115 further comprises an indent along the interchangeable angled member 115 rear surface extending inward towards the base plate 110. The indent is used as a mounting location for a grip pad 120 immediately adjacent to the indent and extending away from the indent. The grip pad 120 aids in securing the hand of the archer during use. In some embodiments, the grip pad 120 is adjoined to the indent with at least one member of an attachment set consisting of: a magnet, a clip, a tab, a slot, a rail, a joint, a heat-shrink material flange, a slide-fit, a clamp, a spring, an elastic member, a snap-fit, a fastener, an elastic member, an adhesive, or any combination thereof. In some embodiments, the grip pad 120 is made of at least one member of a material set consisting of: a wood material, a plastic material, a metal material, a rubber material, a polymer material, a fiberglass material, and a composite material. In some embodiments, the interchangeable angled member 115 and/or the grip pad 120 further comprises an external texture to grip a hand of the user. For example, by way of non-limiting example, the external texture further comprises at least one member of a texture set consisting of: indentations, extrusions, knurling, a rough surface, and bumps.

As seen in FIGS. 1-4, in some embodiments, the riser 101 further comprises a fourth plurality of attachment members (not shown) arranged within a fourth attachment opening on the riser 101 of the bow. In some embodiments, the fourth plurality of attachment members is configured to hold the first locking tab 150 to the riser 101 of the bow by securing the first locking tab 150 within the first locking slot 135 located on the grip mounting area 136. In some embodiments, the fourth plurality of attachment members comprise at least one member of an attachment set consisting of: a magnet, a clip, a tab, a slot, a rail, a joint, a heat-shrink material flange, a slide-fit, a clamp, a spring, an elastic member, a snap-fit, a fastener, an elastic member, an adhesive, or any combination thereof.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, 6. In particular, any use of "step of" in the claims is not intended to invoke the provision of 35 U.S.C. § 112, § 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An interchangeable bow grip system comprising:

a grip mounting area arranged along of a riser of a bow;

a base plate having a front surface and a rear surface, wherein the front surface of the base plate is configured to substantially match the grip mounting area;

an interchangeable angled member having a front surface and a rear surface;

at least one first attachment member arranged between and configured to adjoin the front surface of the base plate and the grip mounting area; and at least one second attachment member arranged between and configured to adjoin the front surface of the interchangeable angled member and the rear surface of the base plate, a second locking tab adjoined to and extending outward from the rear surface of the base plate; and a second locking slot protruding into the front surface of the interchangeable angled member, wherein the second locking tab interfaces with the second locking slot when assembled.

2. The interchangeable bow grip system of claim 1, further comprising:

at least one first attachment opening arranged on the front surface of the base plate.

3. The interchangeable bow grip system of claim 1, further comprising:

at least one second attachment opening arranged on the front surface of the interchangeable angled member.

4. The interchangeable bow grip system of claim 3, further comprising:

at least one third attachment member arranged upon the rear surface of the base plate and configured to adjoin the front surface of the interchangeable angled member to the rear surface of the base plate.

5. The interchangeable bow grip system of claim 4, further comprising:

at least one third attachment opening arranged on the front surface of the base plate.

6. The interchangeable bow grip system of claim 5, wherein the least one third attachment member is configured to substantially match with the at least one second attachment opening and/or the at least one second attachment member.

7. The interchangeable bow grip system of claim 6, wherein the at least one third attachment opening is configured to substantially match with the at least one second attachment opening and/or the at least one second attachment member.

8. The interchangeable bow grip system of claim 4, wherein the at least one third attachment member is at least one member of an attachment set consisting of: a magnet, a clip, a tab, a slot, a rail, a joint, a heat-shrink material flange, a slide-fit, a clamp, a spring, an elastic member, a snap-fit, a fastener, an elastic member, an adhesive, or any combination thereof.

9. The interchangeable bow grip system of claim 1, further comprising:

a first locking tab joined to the front surface of the base plate, wherein the first locking tab extends outward from the front surface of the base plate; and, a first locking slot protruding into the riser of the bow, wherein the first locking tab interfaces with the first locking slot when assembled.

10. The interchangeable bow grip system of claim 9, further comprising:

at least one first attachment opening arranged on the first locking tab.

11. The interchangeable bow grip system of claim 9, wherein the least one first attachment member is arranged upon the first locking tab.

12. The interchangeable bow grip system of claim 1, further comprising at least one second attachment opening arranged within the second locking slot of the interchangeable angled member.

13. The interchangeable bow grip system of claim 1, wherein the at least one second attachment member is arranged within the second locking slot.

14. The interchangeable bow grip system of claim 1, wherein the at least one first attachment member and/or the at least one second attachment member is at least one member of an attachment set consisting of: a magnet, a clip, a tab, a slot, a rail, a joint, a heat-shrink material flange, a slide-fit, a clamp, a spring, an elastic member, a snap-fit, a fastener, an elastic member, an adhesive, or any combination thereof.

15. The interchangeable bow grip system of claim 1, wherein the interchangeable angled member further comprises at least one at least one member of an identification set consisting of: an alphanumeric identification, a human user's name, a symbolic shape, a company brand, a numeric identification number, a QR code, and a barcode.

16. The interchangeable bow grip system of claim 1, wherein the interchangeable angled member further comprises an external texture.

17. The interchangeable bow grip system of claim 16, wherein the external texture further comprises at least one member of a texture set consisting of: indentations, extrusions, knurling, a rough surface, and bumps.

18. An interchangeable bow grip system comprising:

a grip mounting area arranged along of a riser of a bow;

a base plate having a front surface and a rear surface, wherein the front surface of the base plate is configured to substantially match the grip mounting area;

an interchangeable angled member having a front surface and a rear surface;

at least one first attachment member arranged between and configured to adjoin the front surface of the base plate and the grip mounting area; and at least one second attachment member arranged between and configured to adjoin the front surface of the interchangeable angled member and the rear surface of the base plate and;

a second locking tab adjoined to and extending outward from the front surface of the interchangeable angled member; and a second locking slot protruding into the rear surface of the base plate, wherein the second locking tab interfaces with the second locking slot when assembled.

* * * * *